US008646937B2

(12) United States Patent
Yang

(10) Patent No.: US 8,646,937 B2
(45) Date of Patent: Feb. 11, 2014

(54) SWITCH PANEL ILLUMINATION STRUCTURE

(76) Inventor: Hsiu-Ling Yang, Tauyuan (TW)

( * ) Notice: Subject to any disclaimer, the term of this patent is extended or adjusted under 35 U.S.C. 154(b) by 69 days.

(21) Appl. No.: 13/534,982

(22) Filed: Jun. 27, 2012

(65) Prior Publication Data

US 2012/0268919 A1 Oct. 25, 2012

Related U.S. Application Data

(63) Continuation-in-part of application No. 12/878,286, filed on Sep. 9, 2010, now abandoned.

(51) Int. Cl.

| | |
|---|---|
| ***F21L 4/02*** | (2006.01) |
| ***F21V 33/00*** | (2006.01) |
| ***F21L 4/00*** | (2006.01) |
| ***F21L 13/00*** | (2006.01) |
| ***F21S 8/00*** | (2006.01) |
| ***F21V 23/04*** | (2006.01) |

(52) U.S. Cl.
USPC ..... 362/184; 362/183; 362/95; 362/147; 362/276

(58) Field of Classification Search
USPC ..... 362/183, 184, 95, 276, 20, 200, 147
See application file for complete search history.

(56) References Cited

U.S. PATENT DOCUMENTS

| | | | | |
|---|---|---|---|---|
| 4,611,264 | A * | 9/1986 | Bradley | 362/95 |
| 6,010,228 | A * | 1/2000 | Blackman et al. | 362/95 |
| 6,350,039 | B1 * | 2/2002 | Lee | 362/95 |
| 6,762,583 | B2 * | 7/2004 | Ho et al. | 320/107 |
| 6,864,798 | B2 * | 3/2005 | Janik | 340/693.11 |
| 7,347,581 | B2 * | 3/2008 | Krieger | 362/183 |
| 7,578,598 | B2 * | 8/2009 | Robinson et al. | 362/183 |
| 7,581,844 | B1 * | 9/2009 | Yang | 362/95 |
| 2006/0262525 | A1 * | 11/2006 | Barbeau et al. | 362/157 |
| 2007/0153494 | A1 * | 7/2007 | Huang | 362/20 |
| 2008/0239714 | A1 * | 10/2008 | Boettcher | 362/183 |
| 2009/0154148 | A1 * | 6/2009 | Meyer et al. | 362/157 |
| 2009/0185359 | A1 * | 7/2009 | Martinez | 362/20 |

* cited by examiner

*Primary Examiner* — Jong-Suk (James) Lee
*Assistant Examiner* — Bryon T Gyllstrom
(74) *Attorney, Agent, or Firm* — Morris Manning & Martin LLP; Tim Tingkang Xia, Esq.

(57) ABSTRACT

A switch panel illumination structure for mounting to an outer side of an indoor switch includes a panel provided with a receptacle, and an illumination mechanism detachably received in the receptacle. A conductive section is disposed in the receptacle and electrically connected to an AC/DC conversion module. The illumination mechanism has a first and a second light-emitting section electrically connected to an illumination control module thereof, and the illumination control module is electrically connected to the AC/DC conversion module via contacts and the conductive section. The illumination mechanism further has a switch section electrically connected to the first and second light-emitting sections and the illumination control module. The illumination mechanism can be securely located in the receptacle to serve as a night lamp or an emergency light or be easily removed from the receptacle for use as a flashlight without changing the appearance and the size of the panel.

6 Claims, 8 Drawing Sheets

SWITCH PANEL ILLUMINATION STRUCTURE

CROSS-REFERENCE TO RELATED APPLICATION

This application is a continuation-in-part patent application of U.S. application Ser. No. 12/878,286 filed on Sep. 9, 2010, the entire contents of which are hereby incorporated by reference for which priority is claimed under 35 U.S.C. §120.

FIELD OF THE INVENTION

The present invention relates to an improved switch panel illumination structure. The switch panel illumination structure includes a panel and an illumination mechanism detachably received in a receptacle provided on the panel. The illumination mechanism can be securely located in the receptacle of the panel or be easily removed from the panel for use as a flashlight. The appearance and the size of the panel will remain unchanged and tidy without being affected by the illumination mechanism. The switch panel illumination structure can provide nighttime illumination, emergency illumination and mobile illumination effect.

BACKGROUND OF THE INVENTION

A conventional switch panel with illumination structure includes a panel and an illumination mechanism detachably disposed on the panel. An edge of the panel is formed with an insertion channel. At least one lateral side of the illumination mechanism is provided with a guide block, which is slidably inserted in the insertion channel. Accordingly, the illumination mechanism can be mounted on the panel as a night lamp or taken off from the panel and solely used as a flashlight.

The guide block of the illumination mechanism is slidably inserted in the insertion channel of the panel. The insertion channel has a considerable length so that it takes time to move the illumination mechanism out of the panel. Therefore, a user cannot readily use the illumination mechanism. Moreover, in the case that the guide block is not properly assembled with the insertion channel, the guide block will be dislocated and derailed. Under such circumstance, it is impossible to securely associate the illumination mechanism with the panel and the user can hardly conveniently use the illumination mechanism.

In another conventional switch panel with illumination structure, a first attraction section (magnet or metal plate) is arranged on an edge of the panel and a second attraction section (metal plate or magnet) is arranged on one face of the illumination mechanism. The first and second attraction sections can attract each other to easily detachably assemble the illumination mechanism with the panel.

Such measure can overcome the shortcomings existing in the conventional switch panel with the insertion channel and guide block. However, in both the above conventional switch panels, the illumination mechanisms are added to the edges of the panels. The additional illumination mechanism will deteriorate the appearance of the panel and enlarge the size of the panel.

It is therefore tried by the inventor to provide an improved switch panel illumination structure, which includes a panel and an illumination mechanism detachably received in a receptacle provided on the panel. The illumination mechanism can be securely located in the receptacle of the panel or be easily removed from the panel for use as a flashlight. The appearance and the size of the panel will remain unchanged and tidy without being affected by the illumination mechanism. The switch panel illumination structure can provide nighttime illumination, emergency illumination and mobile illumination effect.

SUMMARY OF THE INVENTION

A primary object of the present invention is to provide an improved switch panel illumination structure including a panel and an illumination mechanism. The panel is provided with a receptacle in which the illumination mechanism is detachably received. Accordingly, the illumination mechanism can be securely located in the receptacle on the panel or be easily removed from the panel for use as a flashlight. The appearance and the size of the panel will remain unchanged and tidy without being affected by the illumination mechanism. The switch panel illumination structure can provide nighttime illumination, emergency illumination and mobile illumination effect.

To achieve the above and other objects, the switch panel illumination structure according to a first embodiment of the present invention is mounted to an outer side of an indoor switch and includes a panel and an illuminati on mechanism. The panel is provided on at least one peripheral side thereof with a receptacle, and a conductive section is disposed in the receptacle and electrically connected to an AC/DC conversion module that is connectable to an external power supply. Further, the panel is formed with a through hole, via which the indoor switch is exposed from the panel. The receptacle has a first end forming an opening and an opposite second end forming a stop section with a central through hole. The illumination mechanism is detachably received in the receptacle, and has a first light-emitting section and a second light-emitting section. The illumination mechanism further has an illumination control module electrically connected to the first and second light-emitting sections. The illumination control module is also electrically connected to the AC/DC conversion module via a plurality of contacts and the conductive section. The illumination mechanism further has a switch section electrically connected to the first and second light-emitting sections and the illumination control module. The first light-emitting section is arranged on a lateral side of the illumination mechanism and the second light-emitting section is arranged on one end of the illumination mechanism. Lateral sides of the illumination mechanism are enclosed in the receptacle with the first light-emitting section located corresponding to a light window formed on the receptacle. The second light-emitting section is exposed to an outer side of the panel via the opening of the receptacle. Another opposite end of the illumination mechanism is rest on the stop section of the receptacle. With these arrangements, the illumination mechanism can be moved out of the receptacle via the opening by applying a force on the opposite end of the illumination mechanism via the central through hole on the stop section.

According to a second embodiment of the present invention, the switch panel illumination structure is mounted to an outer side of an indoor switch and includes a panel and an illumination mechanism. The panel is provided on at least one peripheral side thereof with a receptacle, and a conductive section is disposed in the receptacle and electrically connected to an AC/DC conversion module that is connectable to an external power supply. Further, the panel is formed with a through hole, via which the indoor switch is exposed from the panel. The receptacle has a first end forming an opening and an opposite second end internally provided with a first receiving slot, a spring-loaded switch and a clamping element. The spring-loaded switch is mounted in the first receiving slot, and the clamping element is movably connected to the spring-loaded switch and exposed from the first receiving slot. The illumination mechanism is detachably received in the receptacle, and has a first light-emitting section and a second light-emitting section. The illumination mechanism further has an illumination control module electrically connected to the first and second light-emitting sections. The illumination control module is also electrically connected to the AC/DC conversion module via a plurality of contacts and the conductive section. The illumination mechanism further has a switch section electrically connected to the first and second light-emitting sections and the illumination control module. The first light-emitting section is arranged on a lateral side of the illumination mechanism and the second light-emitting section is arranged on one end of the illumination mechanism. Lateral sides of the illumination mechanism are enclosed in the receptacle with the first light-emitting section located corresponding to a light window formed on the receptacle. The second light-emitting section is exposed to an outer side of the panel via the opening of the receptacle. Another opposite end of the illumination mechanism is provided with a second receiving slot and a locating protrusion located in the second receiving slot. When the illumination mechanism is received in the receptacle, the clamping element is extended into and movably located in the second receiving slot; and when the locating protrusion is caused to push the spring-loaded switch, the clamping element would clamp on or release the locating protrusion.

In the switch panel illumination structure according to the present invention, the AC/DC conversion module at least includes a high-frequency switch unit and a current-limiting charging unit, which are electrically connected to each other.

In the switch panel illumination structure according to the present invention, the illumination control module at least includes a rechargeable battery, a boosting circuit, an illumination mode detection unit and an illumination detection unit, which are electrically connected to one another; and the illumination detection unit is arranged on an outer face of the panel.

With the switch panel illumination structure of the present invention, the illumination mechanism can be securely located in the receptacle on the panel or be easily removed from the panel for use as a flashlight. The appearance and the size of the panel will not change due to the illumination mechanism. The switch panel illumination structure can provide nighttime illumination, emergency illumination and mobile illumination effect.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
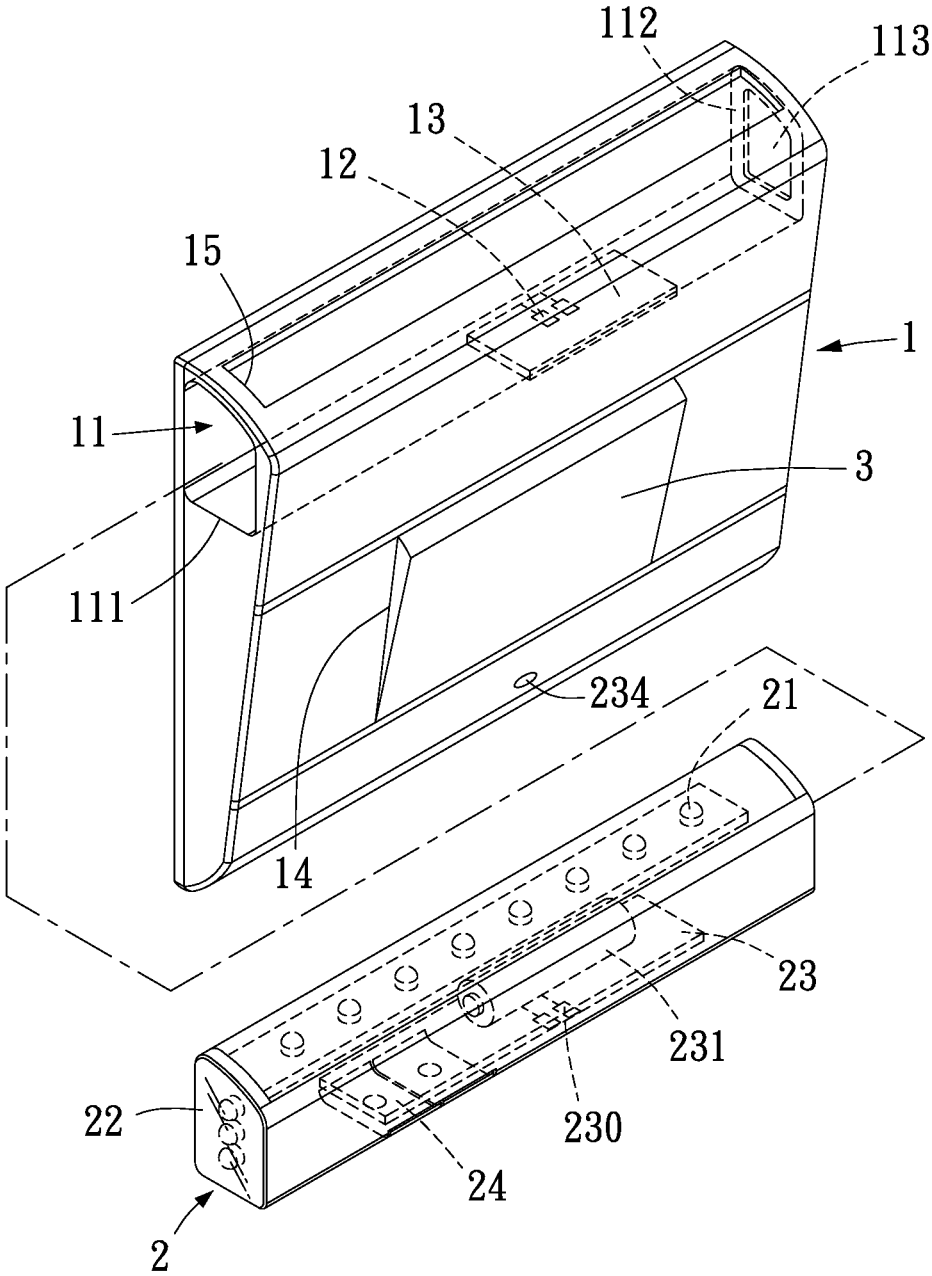
FIG. 1 is a perspective exploded view of a first embodiment of the present invention.
Figure 2:
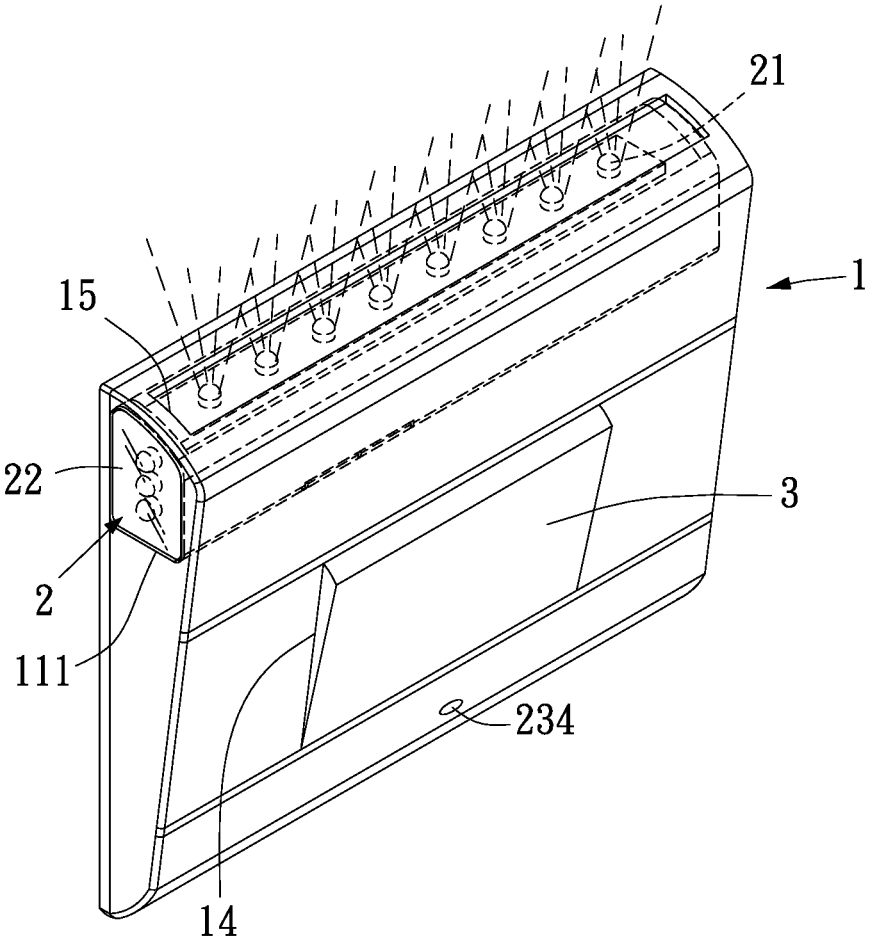
FIG. 2 is a perspective assembled view of the first embodiment of the present invention.
Figure 6:
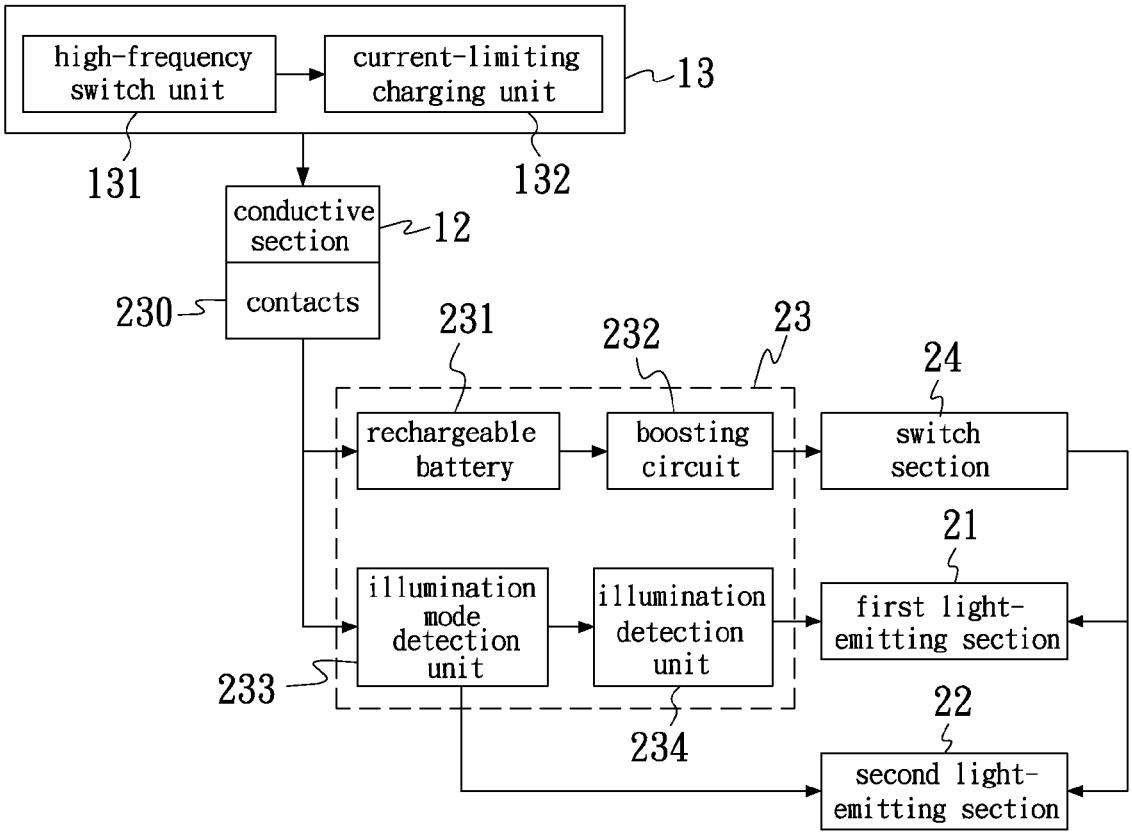
FIG. 6 is a block diagram of an AC/DC conversion module and an illumination control module for the embodiments of the present invention.

Please refer to FIGS. 1, 2 and 6, in which FIG. 1 is a perspective exploded view of a first embodiment of the present invention, FIG. 2 is a perspective assembled view of the first embodiment of the present invention, and FIG. 6 is a block diagram of an AC/DC conversion module and an illumination control module for different embodiments of the present invention. As shown, a switch panel illumination structure according to the first embodiment of the present invention is mounted to an outer side of an indoor switch 3 and includes a panel 1 and an illumination mechanism 2.

The panel 1 has a through hole 14, via which the indoor switch 3 is exposed from the panel 1. The panel is provided on at least one peripheral side with a receptacle 11. A first end of the receptacle 11 is formed with an opening 111, while a second end of the receptacle 11 is formed with a stop section 112. A through hole 113 is formed at a center of the stop section 112. A conductive section 12 is disposed in the receptacle 11 and electrically connected to an AC/DC conversion module 13, which is electrically connectable to an external power supply.

The illumination mechanism 2 is received in the receptacle 11. The illumination mechanism 2 has a first light-emitting section 21 and a second light-emitting section 22. The first light-emitting section 21 can be arranged on a lateral side of the illumination mechanism 2, while the second light-emitting section 22 can be arranged on one end of the illumination mechanism 2. The receptacle 11 encloses the lateral sides of the illumination mechanism 2, and is provided at a position corresponding to the first light-emitting section 21 with a light window 15, and the second light-emitting section 22 is exposed to an outer side of the receptacle 11 via the opening 111. Another opposite end of the illumination mechanism 2 is rest on the stop section 112 of the receptacle 11. The illumination mechanism 2 can be moved out of the receptacle 11 via the opening 111 by applying a force on the opposite end of the illumination mechanism 2 via the through hole 113 on the stop section 112. The illumination mechanism 2 further has an illumination control module 23 electrically connected to the first and second light-emitting sections 21, 22. The illumination control module 23 is electrically connected to the AC/DC conversion module 13 via a plurality of contacts 230 and the conductive section 12. In addition, the illumination mechanism 2 further has a switch section electrically connected to the first and second light-emitting sections 21, 22 and the illumination control module 23.

Figure 3:
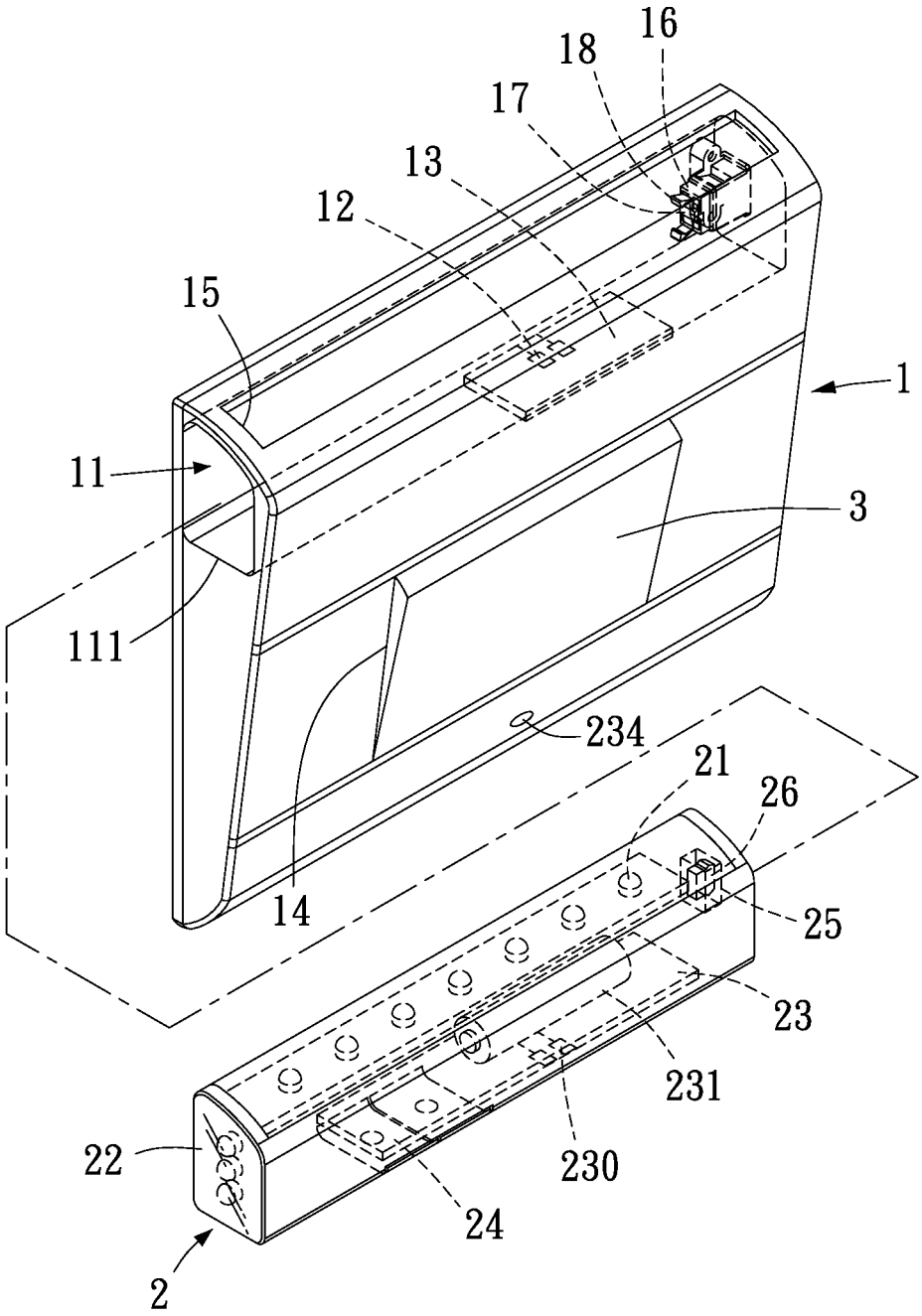
FIG. 3 is a perspective exploded view of a second embodiment of the present invention.
Figure 4:
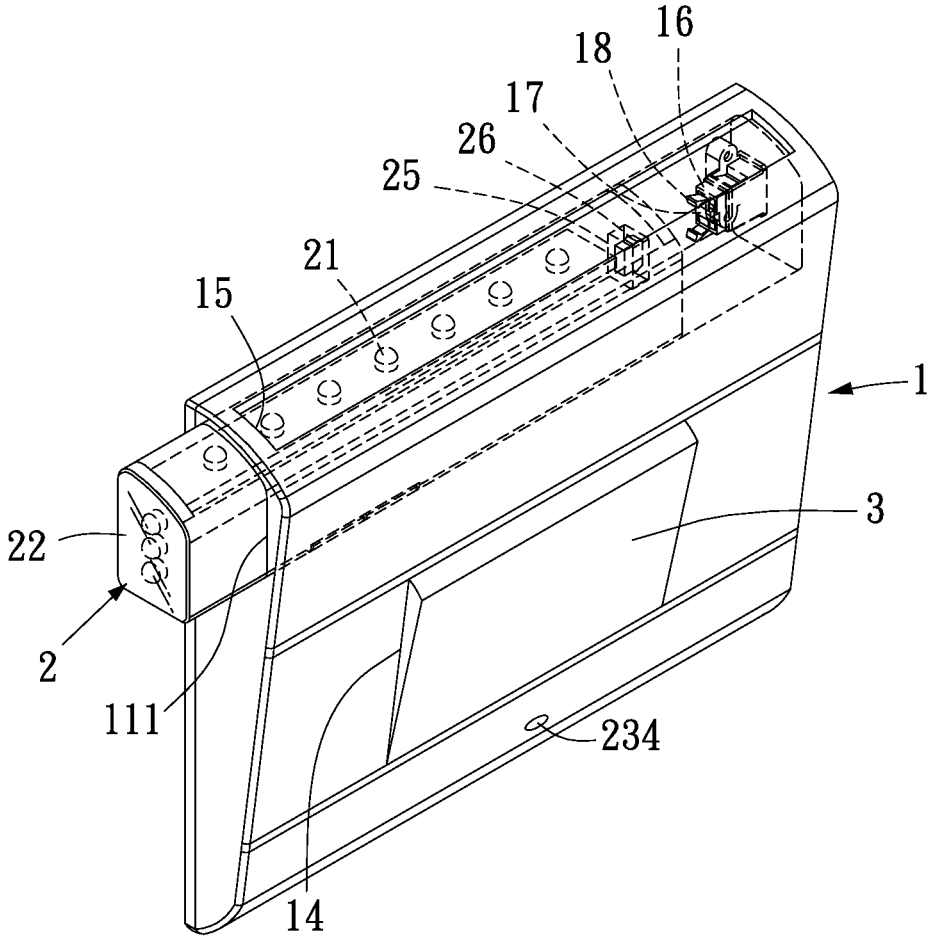
FIG. 4 is a perspective assembled view of the second embodiment of the present invention.
Figure 5:
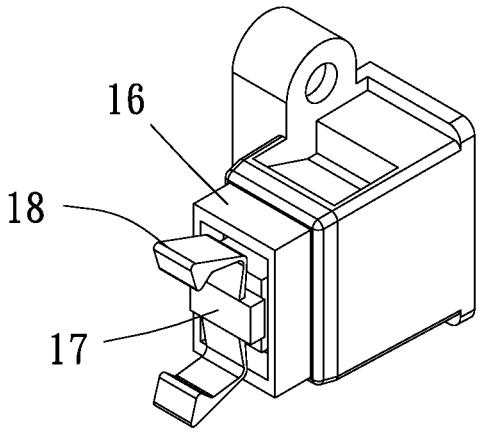
FIG. 5 is a perspective assembled view showing a first receiving slot, a spring-loaded switch and a clamping element included in the second embodiment of the present invention.

Please refer to FIGS. 3, 4 and 5, in which FIG. 3 is a perspective exploded view of a second embodiment of the present invention, FIG. 4 is a perspective assembled view of the second embodiment of the present invention, and FIG. 5 is a perspective assembled view showing a first receiving slot, a spring-loaded switch and a clamping element included in the second embodiment of the present invention. As shown, the second embodiment of the present invention is different from the first embodiment in that the receptacle 11 thereof is internally provided on the second end with a first receiving slot 16, a spring-loaded switch 17 and a clamping element 18. The spring-loaded switch 17 is mounted in the first receiving slot 16 and is a pushbutton switch. A surface of the spring-loaded switch 17 will retract into the first receiving slot 16 when the switch 17 is pushed one time; and the surface of the spring-loaded switch 17 will spring back to its original position when the switch 17 is pushed again. The clamping element 18 is movably connected close to the surface of the spring-loaded switch 17 and is exposed from the first receiving slot 16. Meanwhile, the illumination mechanism 2 is provided on its opposite end with a second receiving slot 25 and a locating protrusion 26 located in the second receiving slot 25. When the illumination mechanism 2 is received in the receptacle 11, the clamping element 18 is extended into and movably located in the second receiving slot 25; and when the locating protrusion 26 is caused to push the spring-loaded switch 17, the clamping element 18 will clamp on or release the locating protrusion 16.

Figure 7:
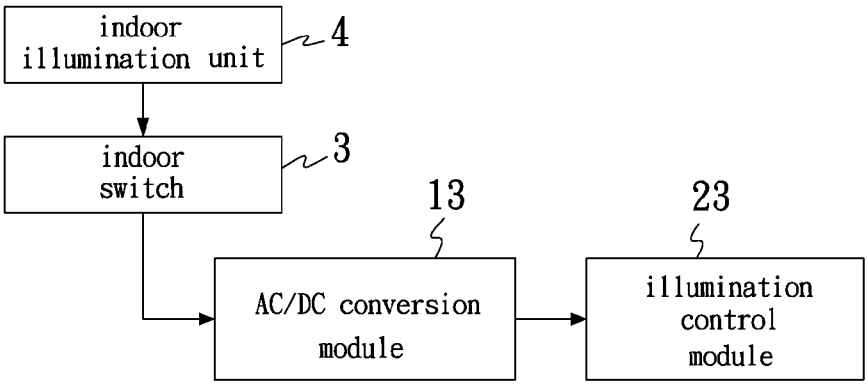
FIG. 7 is a block diagram of circuit connection for the embodiments of the present invention.
Figure 8:
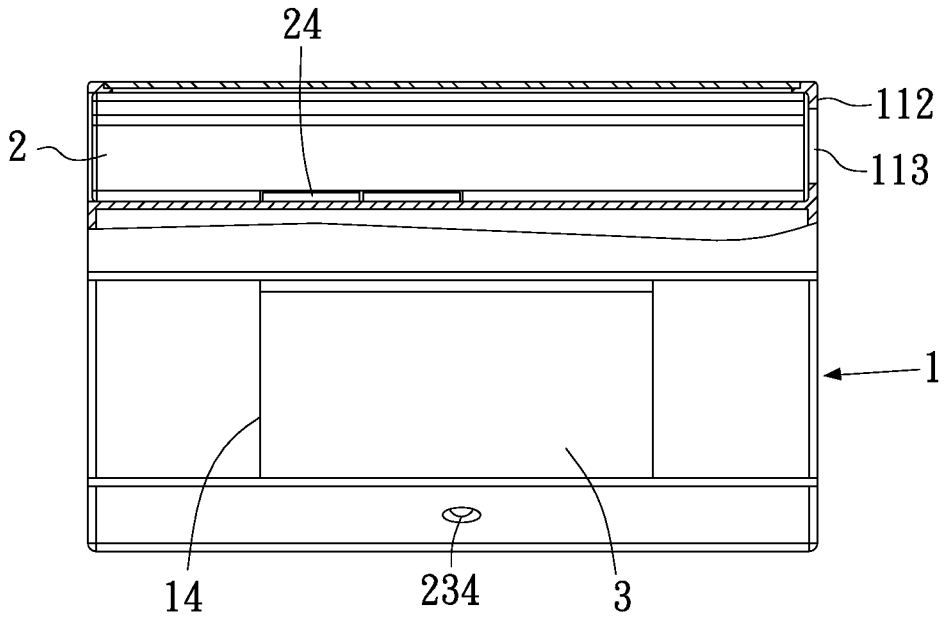
FIG. 8 is a sectional view of the first embodiment of the present invention.
Figure 10:
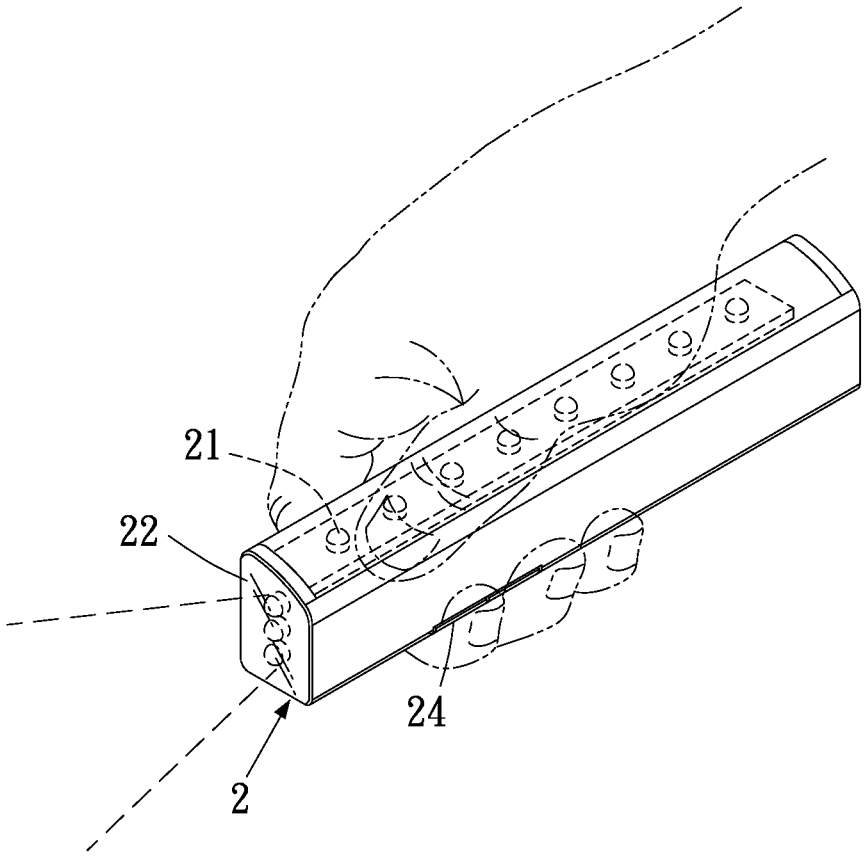
FIG. 10 shows the use of different embodiments of the present invention in a flashlight mode.

Please refer to FIGS. 7, 8 and 10, in which FIG. 7 is a block diagram of circuit connection for different embodiments of the present invention, FIG. 8 is a sectional view of the first embodiment of the present invention, and FIG. 10 shows the use of different embodiments of the present invention in a flashlight mode. As shown in FIGS. 7, 8 and 10, to use the first embodiment of the present invention illustrated in FIGS. 1, 2 and 6, the panel 1 can be mounted to an outer side of a common indoor switch 3 or a power socket in substitution for an original switch panel. Since the illumination mechanism 2 is received in the receptacle 11 formed on one peripheral side of the panel 1, the appearance and the size of the panel 1 will remain unchanged and tidy without being affected by the illumination mechanism 2. In view that the indoor switch 3 originally has a power distribution circuit that includes only one live wire (as a positive electrode) and therefore could not be used to charge the AC/DC conversion module 13, the illumination mechanism 2 and the illumination control module 23, the circuit connection for the first embodiment of the present invention further includes a grounding wire added to the power distribution circuit of the indoor switch 3 as a negative electrode to provide a negative electrode circuit between the indoor switch 3 and an indoor illumination unit 4. Under such circumstance, after the illumination mechanism 2 is connected to the power supply of the indoor switch 3 via the conductive section 12 and the AC/DC conversion module 13, in the case that the indoor illumination unit 4 is turned off via the indoor switch 3, a negative electrode circuit is formed for charging the illumination mechanism 2.

Figure 9:
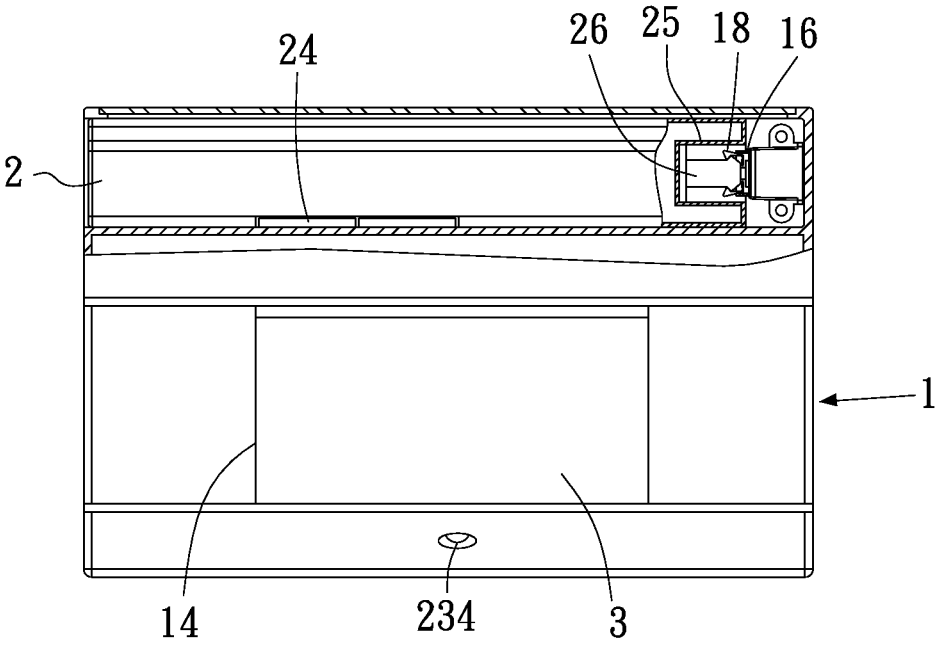
FIG. 9 is a sectional view of the second embodiment of the present invention.

Please refer to FIGS. 7, 9 and 10, in which FIG. 7 is a block diagram of circuit connection for different embodiments of the present invention, FIG. 9 is a sectional view of the second embodiment of the present invention, and FIG. 10 shows the use of different embodiments of the present invention in a flashlight mode. As shown, the second embodiment of the present invention can be used in the same manner as the first embodiment.

According to the first embodiment as shown in FIGS. 1, 2 and 6, when it is desired to use the illumination mechanism 2 with the panel 1, simply put the illumination mechanism 2 into the receptacle 11 from the opening 111. The stop section 112 at the second end of the receptacle 11 serves to prevent the illumination mechanism 2 from dropping out of the receptacle and keep the illumination mechanism 2 securely associated with the panel 1. Also, the contacts 230 of the illumination control module 23 are in contact with the conductive section 12 to electrically connect the illumination control module 23 with the AC/DC conversion module 13. The AC/DC conversion module 13 not only supplies necessary power for the illumination mechanism 2 to operate, but also charges a rechargeable battery 231 of the illumination mechanism 2. During charging, a high-frequency switch unit 131 converts AC high voltage into DC low voltage at high efficiency. A current-limiting charging unit 132 cooperates with the high-frequency switch unit 131 to protect the rechargeable battery 231. The rechargeable battery 231 has a lower voltage itself. Therefore, when using the rechargeable battery 231, the voltage is boosted with a boosting circuit 232 for driving the first and second light-emitting sections 21, 22 to emit light. On the other hand, the second embodiment as shown in FIGS. 3, 4, 5 and 6 is different from the first embodiment in that the illumination mechanism 2 put into the receptacle 11 via the opening 111 will bring the locating protrusion 26 to push the spring-loaded switch 17 one time. At this point, the surface of the spring-loaded switch 17 along with the clamping element 18 retract into the first receiving slot 16, and two opposite sides of the clamping element 18 are inward compressed by an inner wall surface of the first receiving slot 16 to thereby clamp on the locating protrusion 26, so that the illumination mechanism 2 is securely connected to the panel 1.

According to the first embodiment as shown in FIGS. 1, 2 and 6, after the illumination mechanism 2 is connected with the panel 1, an illumination detection unit 234 of the illumination control module 23 serves to detect the ambient light source. In the case of darkness or blackout, the first light-emitting section 21 is turned on to provide illumination as a night lamp or an emergency light, as shown in FIG. 2. Reversely, when the ambient light source is sufficient, the illumination detection unit 234 turns off the first light-emitting section 21 and the rechargeable battery 231 is charged. In the case of blackout, the first light-emitting section 21 will emit light as an emergency light for a user to locate the illumination mechanism 2. Then the user can apply a force to the other end of the illumination mechanism 2, i.e. a bottom section thereof, via the through hole 113 of the stop section 112, so as to push the illumination mechanism 2 out of the opening 111 and detach the illumination mechanism 2 from the receptacle 11. Accordingly, the illumination mechanism 2 can be easily removed from the panel 1. When the illumination control module 23 is separated from the AC/DC conversion module 13, an illumination mode detection unit 233 will switch the illumination mechanism 2 to a flashlight mode. At this time, the user only needs to switch on the switch section 24, and the rechargeable battery 231 will supply power to turn on the second light-emitting section 22 for the illumination mechanism 2 to serve as a flashlight, as shown in FIG. 10. After use, the user only needs to replace the illumination mechanism 2 into the receptacle 11 via the opening 111 and the illumination mechanism 2 is securely connected to the panel 1. When the illumination control module 23 is connected to the AC/DC conversion module 13 again, the illumination mode detection unit 233 will switch the illumination mechanism 2 to a night lamp mode. No matter whether the illumination mechanism 2 is set to the night lamp mode or the flashlight mode, the first and second light-emitting sections 21, 22 can be turned on or off by means of the switch section 24 in cooperation with the rechargeable battery 231.

The use of the second embodiment shown in FIGS. 3, 4, 5 and 6 is different from the first embodiment in that, in case of blackout, the illumination mechanism 2 should first be pushed at the second light-emitting section 22 for the locating protrusion 26 to press the spring-loaded switch 17 again, so that the surface of the spring-loaded switch 17 and the clamping element 18 spring back to their original position. At this point, the two opposite sides of the clamping element 18 are no longer compressed inward by the inner wall surface of the first receiving slot 16 and the locating protrusion 26 is released from the clamping element 18, allowing the user to remove the illumination mechanism 2 from the receptacle 11 via the opening 111. In this manner, the illumination mechanism 2 can also be easily separated from the panel 1 for use independently.

In conclusion, the illumination mechanism can be securely located in the receptacle of the panel or easily taken off from the panel to serve as a flashlight. The illumination mechanism is received in the receptacle of the panel so that the appearance and the size of the panel will remain unchanged and tidy without being affected by the illumination mechanism. The present invention can provide nighttime illumination, emergency illumination and mobile illumination effect to fully satisfy the current demands on the market.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. A switch panel illumination structure mounted to an outer side of an indoor switch, comprising:

a panel being provided on at least one peripheral side thereof with a receptacle; a conductive section being disposed in the receptacle and electrically connected to an AC/DC conversion module that is connectable to an external power supply; further, the panel being formed with a through hole, via which the indoor switch is exposed from the panel; and the receptacle having a first end forming an opening and an opposite second end forming a stop section with a central through hole; and an illumination mechanism being detachably received in the receptacle; the illumination mechanism having a first light-emitting section and a second light-emitting section, the illumination mechanism further having an illumination control module electrically connected to the first and second light-emitting sections; the illumination control module also being electrically connected to the AC/DC conversion module via a plurality of contacts and the conductive section; the illumination mechanism further having a switch section electrically connected to the first and second light-emitting sections and the illumination control module; the first light-emitting section being arranged on a lateral side of the illumination mechanism and the second light-emitting section being arranged on one end of the illumination mechanism; lateral sides of the illumination mechanism being enclosed in the receptacle with the first light-emitting section located corresponding to a light window formed on the receptacle; the second light-emitting section being exposed to an outer side of the panel via the opening of the receptacle; and another opposite end of the illumination mechanism being rest on the stop section of the receptacle; whereby the illumination mechanism can be removed from the receptacle via the opening by applying a force on the opposite end of the illumination mechanism via the central through hole on the stop section.

2. The switch panel illumination structure as claimed in claim 1, wherein the AC/DC conversion module at least includes a high-frequency switch unit and a current-limiting charging unit, which are electrically connected to each other.

3. The switch panel illumination structure as claimed in claim 1, wherein the illumination control module at least includes a rechargeable battery, a boosting circuit, an illumination mode detection unit and an illumination detection unit, which are electrically connected to one another; and the illumination detection unit being arranged on an outer face of the panel.

4. A switch panel illumination structure mounted to an outer side of an indoor switch, comprising:

a panel being provided on at least one peripheral side thereof with a receptacle; a conductive section being disposed in the receptacle and electrically connected to an AC/DC conversion module that is connectable to an external power supply; further, the panel being formed with a through hole, via which the indoor switch is exposed from the panel; and the receptacle having a first end forming an opening and an opposite second end internally provided with a first receiving slot, a spring-loaded switch and a clamping element; the spring-loaded switch being mounted in the first receiving slot, and the clamping element being movably connected to the spring-loaded switch and exposed from the first receiving slot; and an illumination mechanism being detachably received in the receptacle; the illumination mechanism having a first light-emitting section and a second light-emitting section, the illumination mechanism further having an illumination control module electrically connected to the first and second light-emitting sections; the illumination control module also being electrically connected to the AC/DC conversion module via a plurality of contacts and the conductive section; the illumination mechanism further having a switch section electrically connected to the first and second light-emitting sections and the illumination control module; the first light-emitting section being arranged on a lateral side of the illumination mechanism and the second light-emitting section being arranged on one end of the illumination mechanism; lateral sides of the illumination mechanism being enclosed in the receptacle with the first light-emitting section located corresponding to a light window formed on the receptacle; the second light-emitting section being exposed to an outer side of the panel via the opening of the receptacle; and another opposite end of the illumination mechanism being provided with a second receiving slot and a locating protrusion located in the second receiving slot; whereby when the illumination mechanism is received in the receptacle, the clamping element is extended into and movably located in the second receiving slot; and when the locating protrusion is caused to push the spring-loaded switch, the clamping element would clamp on or release the locating protrusion.

5. The switch panel illumination structure as claimed in claim 4, wherein the AC/DC conversion module at least includes a high-frequency switch unit and a current-limiting charging unit, which are electrically connected to each other.

6. The switch panel illumination structure as claimed in claim 4, wherein the illumination control module at least includes a rechargeable battery, a boosting circuit, an illumination mode detection unit and an illumination detection unit, which are electrically connected to one another; and the illumination detection unit being arranged on an outer face of the panel.

* * * * *